US011492170B2

(12) United States Patent
Mellecker

(10) Patent No.: US 11,492,170 B2
(45) Date of Patent: Nov. 8, 2022

(54) PACKAGING ARTICLES

(71) Applicant: Kirk Mellecker, Friday Harbor, WA (US)

(72) Inventor: Kirk Mellecker, Friday Harbor, WA (US)

( * ) Notice: Subject to any disclaimer, the term of this patent is extended or adjusted under 35 U.S.C. 154(b) by 44 days.

(21) Appl. No.: 17/114,745

(22) Filed: Dec. 8, 2020

(65) Prior Publication Data

US 2022/0177182 A1 Jun. 9, 2022

(51) Int. Cl.
*B65D 5/48* (2006.01)
*B65D 71/36* (2006.01)
*B65D 5/50* (2006.01)

(52) U.S. Cl.
CPC ..... *B65D 5/48014* (2013.01); *B65D 5/5021* (2013.01); *B65D 71/36* (2013.01); *B65D 2571/00166* (2013.01); *B65D 2571/00203* (2013.01)

(58) Field of Classification Search
CPC ..... B65D 2571/0066; B65D 5/5021; B65D 2571/00839; B65D 5/50; B65D 2571/00203; B65D 2571/00166; B65D 71/36; B65D 5/48014
USPC ..... 229/120.12, 120.18, 104, 120.23, 925, 229/120.08; 206/192, 427; 220/23.83
See application file for complete search history.

(56) References Cited

U.S. PATENT DOCUMENTS 1,168,565 A * 1/1916 Rosenwald ..... B65D 5/12 229/5.5
4,880,115 A 11/1989 Chaussadas
4,919,269 A 4/1990 Wright et al.
5,265,798 A 11/1993 DeMaio et al.
5,520,283 A 5/1996 Sutherland
(Continued)

FOREIGN PATENT DOCUMENTS

CN 201842314 U 5/2011
CN 108216824 A 6/2018

OTHER PUBLICATIONS

The Spirited Shipper, home website, available at https://spiritedshipper.com, accessed Dec. 8, 2020.
(Continued)

*Primary Examiner* — Christopher R Demeree
(74) *Attorney, Agent, or Firm* — Kirton McConkie; Adam D. Stevens

(57) ABSTRACT

An improved shipping article includes a single piece of substantially planar material with parallel scores formed therein thereby defining substantially planar sections of the shipping article, the planar sections of the shipping article defining, when the piece of substantially planar material is folded along the parallel scores, a first pair of opposing, substantially parallel, spaced-apart sides, a second pair of opposing, substantially parallel, spaced-apart sides that are substantially perpendicular to the first pair of sides, and a pair of dividing walls located adjacent each other and dividing a compartment formed by the first and second pairs of sides into two sub-compartments. A top extension is sized and shaped to fold down to form a top of one of the sub-compartments. Each of the top extensions includes a hole therein sized to receive a human finger or thumb to facilitate lifting, and shelves form sub-sub-compartments.

20 Claims, 9 Drawing Sheets

(56) References Cited

U.S. PATENT DOCUMENTS

| | | | | |
|---|---|---|---|---|
| 5,967,320 | A * | 10/1999 | Cappels | B65D 5/5045 206/434 |
| 7,882,950 | B2 | 2/2011 | Nazari | |
| 8,096,413 | B2 | 1/2012 | Coltri De Paula | |
| 8,523,048 | B1 | 9/2013 | Spiegelman | |
| 8,628,000 | B2 | 1/2014 | Spivey, Sr. et al. | |
| 8,967,380 | B2 | 3/2015 | Moncrief et al. | |
| 9,604,768 | B2 * | 3/2017 | Ramsuer | B65D 71/36 |
| 10,106,291 | B2 | 10/2018 | Kearns | |
| 10,322,845 | B2 | 6/2019 | Boersma et al. | |
| 10,894,646 | B2 * | 1/2021 | Simpkins | B65D 85/20 |
| 10,913,567 | B2 * | 2/2021 | Nelson | B65D 5/002 |
| 10,994,889 | B1 * | 5/2021 | Rumsam | B65D 5/5004 |
| 2005/0000840 | A1 | 1/2005 | Cahill | |
| 2009/0065559 | A1 | 3/2009 | Parkes | |
| 2014/0367380 | A1 * | 12/2014 | Stewart | B65D 71/36 53/467 |
| 2019/0031390 | A1 * | 1/2019 | Hessburg | B65D 5/02 |
| 2020/0031548 | A1 | 1/2020 | Smalley | |
| 2021/0394952 | A1 * | 12/2021 | Chen | B65D 5/6655 |

OTHER PUBLICATIONS

The Spirited Shipper, Two Bottle Magnum Shipping Box, available at https://spiritedshipper.com/shop/wine-shipping-boxes-with-inserts/wine-magnum-shippers/two-bottle-magnum-shipping-box/, accessed Dec. 8, 2020.

The Packaging Pro, Luxury Custom Printed 2 Bottle Cardboard Kraft Paper Corrugated Wine Box with Die Cut Handle, available at https://www.thepackagingpro.com/corrugated-box-manufacturers/luxury-custom-printed-2-bottle-cardboard-kraft-paper-corrugated-wine-box-with-die-cut-handle/, accessed Dec. 8, 2020.

Rimco, Craft Corrugated Presentation Box Opened, available at https://rimcoinc.com/products/boxes/ and specifically at https://rimcoinc.com/wp-content/uploads/2019/03/dscn0052.jpg, accessed Dec. 8, 2020.

* cited by examiner

PACKAGING ARTICLES

BACKGROUND OF THE INVENTION

1. Field of the Invention

The present invention relates to packaging articles, and more particularly to improved packaging articles for shipping fragile items.

2. Background and Related Art

Articles for shipping fragile items such as glass bottles, cans, and other beverage containers need to provide adequate protection for the shipped items. Thus, the shipping articles should be able to dampen vibration and absorb shock from any angle. Ideally, such shipping articles should also be durable, lightweight, affordable, environmentally friendly, and easy-to-use. Once shipped items arrive at their destination, it should also be easy for the recipient to remove the shipped articles without damaging them.

BRIEF SUMMARY OF THE INVENTION

Implementation of the invention provides improved shipping articles that satisfy the needs for shipping of fragile items such as glass bottles, cans, and other beverage containers. Such shipping articles are filled and inserted into a secondary shipping container, such as an external box, for shipping of the items with adequate protection for the fragile items. The fragile items are protected from vibration and shock during shipping.

Certain implementations of the invention provide an improved shipping article including a single piece of substantially planar material with parallel scores formed therein thereby defining six substantially planar sections of the shipping article, the six planar sections of the shipping article defining, when the piece of substantially planar material is folded along the parallel scores, a first pair of opposing, substantially parallel, spaced-apart sides, a second pair of opposing, substantially parallel, spaced-apart sides that are substantially perpendicular to the first pair of sides, and a pair of dividing walls located adjacent each other and dividing a compartment formed by the first and second pairs of sides into two sub-compartments. Each of the planar sections defining the dividing walls includes a top extension sized and shaped to fold down to form a top of one of the sub-compartments. Each of the top extensions includes a hole therein sized to receive a human finger or thumb to facilitate lifting of the shipping article by the top extensions during insertion of or removal of the shipping article from a secondary shipping container.

In some implementations, the parallel scores further define a seventh substantially planar section of the shipping article. When the piece of substantially flat material is folded along the parallel scores, two of the planar sections of the shipping article jointly form one of the two of the first pair of opposing, substantially parallel, spaced-apart sides. A single third planar section of the shipping article forms the other of the first pair of opposing, substantially parallel, spaced-apart sides. In some of such implementations, the sub-compartments have a substantially rectangular cross-section when taken substantially perpendicular to the material of the sides. In some of such implementations, the sub-compartments have a substantially square cross-section when taken substantially perpendicular to the material of the sides. In some of such implementations, each of the planar sections defining the dividing walls further includes a bottom extension sized and shaped to fold up to form a bottom of one of the sub-compartments. The substantially planar material further includes a plurality of slits extending between adjacent sides of the first and second pairs of sides separating portions thereof above and below the top and the bottom of the sub-compartments, thereby permitting the portions above and below the top and the bottom of the sub-compartments to be inwardly displaced after the piece of substantially planar material is folded and the tops and the bottoms of the sub-compartments are folded down and up, respectively, to hold the tops and the bottoms of the sub-compartments in place. In some of such implementations, the piece of substantially planar material includes two of the plurality of slits for each top and for each bottom of the sub-compartments.

In some implementations, each of the planar sections defining the dividing walls further includes a bottom extension sized and shaped to fold up to form a bottom of one of the sub-compartments. The substantially planar material further includes a plurality of slits extending between adjacent sides of the first and second pairs of sides separating portions thereof above the tops and below the bottoms of the sub-compartments, thereby permitting the portions above the tops and below the bottoms of the sub-compartments to be inwardly displaced after the piece of substantially planar material is folded and the tops and the bottoms of the sub-compartments are folded down and up, respectively, to hold the tops and the bottoms of the sub-compartments in place.

In some implementations, one or more of the sides of the first pair of opposing sides or the second pair of opposing sides includes an item-separating shelf formed as a portion of the single piece of substantially planar material detached from its respective side except along a line substantially perpendicular to the parallel scores, whereby the shelf is adapted to fold into one of the sub-compartments to separate such sub-compartment into vertically spaced sub-sub-compartments. In some of such implementations, the shipping article includes item-separating shelves such as two item-separating shelves separating the two sub-compartments into four sub-sub-compartments, four item-separating shelves separating the two sub-compartments into six sub-sub-compartments, six item-separating shelves separating the two sub-compartments into eight sub-sub-compartments.

In some implementations, the single piece of material includes or is corrugated cardboard. In some implementations, the sub-compartments are sized to receive items such as wine bottles, aluminum beverage cans, beverage bottles, beverage growlers, beverage crowlers, and beverage bombers. In some implementations, when the shipping article is folded, the shipping article contains and protects two or more items in the sub-compartments between the tops and bottoms formed by bottom extensions sized and shaped to fold up from the planar sections defining the dividing walls. When the shipping article is located within an external box that encloses the shipping article, the external box and the shipping article form a first crush void above the tops, and a second crush void below the bottoms, the first and second crush voids being defined by portions of the first and second pairs of opposing sides that extend beyond the bottoms and the tops.

According to some implementations, an improved shipping article includes a single piece of substantially planar material with parallel scores formed therein thereby defining seven substantially planar sections of the shipping article, the seven planar sections of the shipping article defining, when the piece of substantially planar material is folded along the parallel scores, a first pair of opposing, substantially parallel, spaced-apart sides, one of the first pair of sides being formed of a single of the planar sections and the other of the first pair of sides being formed of two other of the planar sections, a second pair of opposing, substantially parallel, spaced-apart sides that are substantially perpendicular to the first pair of sides, and a pair of dividing walls located adjacent each other and dividing a compartment formed by the first and second pairs of sides into two sub-compartments. Each of the planar sections defining the dividing walls includes a top extension sized and shaped to fold down to form a top of one of the sub-compartments, and a bottom extension sized and shaped to fold up to form a bottom of one of the sub-compartments.

In some implementations, each of the top extensions includes a hole therein sized to receive a human finger or thumb to facilitate lifting of the shipping article by the top extensions during insertion of or removal of the shipping article from a secondary shipping container. In some implementations, the sub-compartments have a substantially square cross-section when taken substantially perpendicular to the material of the sides. In some implementations, the substantially planar material further includes two slits for each bottom of the sub-compartments and for each top of the sub-compartments, the slits extending between adjacent sides of the first and second pairs of sides separating portions thereof above and below the top and the bottom of the sub-compartments, thereby permitting the portions above the tops and below the bottoms of the sub-compartments to be inwardly displaced after the piece of substantially planar material is folded and the tops and the bottoms of the sub-compartments are folded down and up, respectively, to hold the tops and the bottoms of the sub-compartments in place.

In some implementations, one or more of the sides of the first pair of opposing sides or the second pair of opposing sides includes an item-separating shelf formed as a portion of the single piece of substantially planar material detached from its respective side except along a line substantially perpendicular to the parallel scores, whereby the shelf is adapted to fold into one of the sub-compartments to separate such sub-compartment into vertically spaced sub-sub-compartments. In some of such implementations, the shipping article includes item-separating shelves such as two item-separating shelves separating the two sub-compartments into four sub-sub-compartments, four item-separating shelves separating the two sub-compartments into six sub-sub-compartments, six item-separating shelves separating the two sub-compartments into eight sub-sub-compartments.

In some implementations, the single piece of material includes or is corrugated cardboard. In some implementations, the sub-compartments are sized to receive items such as wine bottles, aluminum beverage cans, beverage bottles, beverage growlers, beverage crowlers, and beverage bombers. In some implementations, when the shipping article is folded, the shipping article contains and protects two or more items in the sub-compartments between the tops and bottoms formed by bottom extensions sized and shaped to fold up from the planar sections defining the dividing walls. When the shipping article is located within an external box that encloses the shipping article, the external box and the shipping article form a first crush void above the tops, and a second crush void below the bottoms, the first and second crush voids being defined by portions of the first and second pairs of opposing sides that extend beyond the bottoms and the tops.

According to some implementations, an improved shipping article includes a single piece of substantially planar material with parallel scores formed therein thereby defining six substantially planar sections of the shipping article, the six planar sections of the shipping article defining, when the piece of substantially planar material is folded along the parallel scores, a first pair of opposing, substantially parallel, spaced-apart sides, a second pair of opposing, substantially parallel, spaced-apart sides that are substantially perpendicular to the first pair of sides, and a pair of dividing walls located adjacent each other and dividing a compartment formed by the first and second pairs of sides into two sub-compartments. Each of the planar sections defining the dividing walls includes a top extension sized and shaped to fold down to form a top of one of the sub-compartments and a bottom extension sized and shaped to fold up to form a bottom of one of the sub-compartments. One or more of the sides of the first pair of opposing sides or the second pair of opposing sides includes an item-separating shelf formed as a portion of the single piece of substantially planar material detached from its respective side except along a line substantially perpendicular to the parallel scores, whereby the shelf is adapted to fold into one of the sub-compartments to separate such sub-compartment into vertically spaced sub-sub-compartments.

In some implementations, the parallel scores further define a seventh substantially planar section of the shipping article, wherein when the piece of substantially flat material is folded along the parallel scores, two of the planar sections of the shipping article jointly form one of the two of the first pair of opposing, substantially parallel, spaced-apart sides, and a single third planar section of the shipping article forms the other of the first pair of opposing, substantially parallel, spaced-apart sides. In some of such implementations, the sub-compartments have a substantially square cross-section when taken substantially perpendicular to the material of the sides. In some of such implementations, each of the planar sections defining the dividing walls further includes a bottom extension sized and shaped to fold up to form a bottom of one of the sub-compartments. The substantially planar material further includes a plurality of slits extending between adjacent sides of the first and second pairs of sides separating portions thereof above and below the top and the bottom of the sub-compartments, thereby permitting the portions above and below the top and the bottom of the sub-compartments to be inwardly displaced after the piece of substantially planar material is folded and the tops and the bottoms of the sub-compartments are folded down and up, respectively, to hold the tops and the bottoms of the sub-compartments in place. In some of such implementations, the piece of substantially planar material includes two of the plurality of slits for each top and for each bottom of the sub-compartments.

In some implementations, each of the top extensions includes a hole therein sized to receive a human finger or thumb to facilitate lifting of the shipping article by the top extensions during insertion of or removal of the shipping article from a secondary shipping container. In some implementations, the substantially planar material further includes a plurality of slits extending between adjacent sides of the first and second pairs of sides separating portions thereof above the tops and below the bottoms of the sub-compartments, thereby permitting the portions above the tops and below the bottoms of the sub-compartments to be inwardly displaced after the piece of substantially planar material is folded and the tops and the bottoms of the sub-compartments are folded down and up, respectively, to hold the tops and the bottoms of the sub-compartments in place.

In some implementations, the shipping article includes item-separating shelves such as two item-separating shelves separating the two sub-compartments into four sub-sub-compartments, four item-separating shelves separating the two sub-compartments into six sub-sub-compartments, six item-separating shelves separating the two sub-compartments into eight sub-sub-compartments.

In some implementations, the single piece of material includes or is corrugated cardboard. In some implementations, the sub-compartments are sized to receive items such as wine bottles, aluminum beverage cans, beverage bottles, beverage growlers, beverage crowlers, and beverage bombers. In some implementations, when the shipping article is folded, the shipping article contains and protects two or more items in the sub-compartments between the tops and bottoms formed by bottom extensions sized and shaped to fold up from the planar sections defining the dividing walls. When the shipping article is located within an external box that encloses the shipping article, the external box and the shipping article form a first crush void above the tops, and a second crush void below the bottoms, the first and second crush voids being defined by portions of the first and second pairs of opposing sides that extend beyond the bottoms and the tops.

BRIEF DESCRIPTION OF THE SEVERAL VIEWS OF THE DRAWINGS

The objects and features of the present invention will become more fully apparent from the following description and appended claims, taken in conjunction with the accompanying drawings. Understanding that these drawings depict only typical embodiments of the invention and are, therefore, not to be considered limiting of its scope, the invention will be described and explained with additional specificity and detail through the use of the accompanying drawings in which:

DETAILED DESCRIPTION OF THE INVENTION

Figure 1:
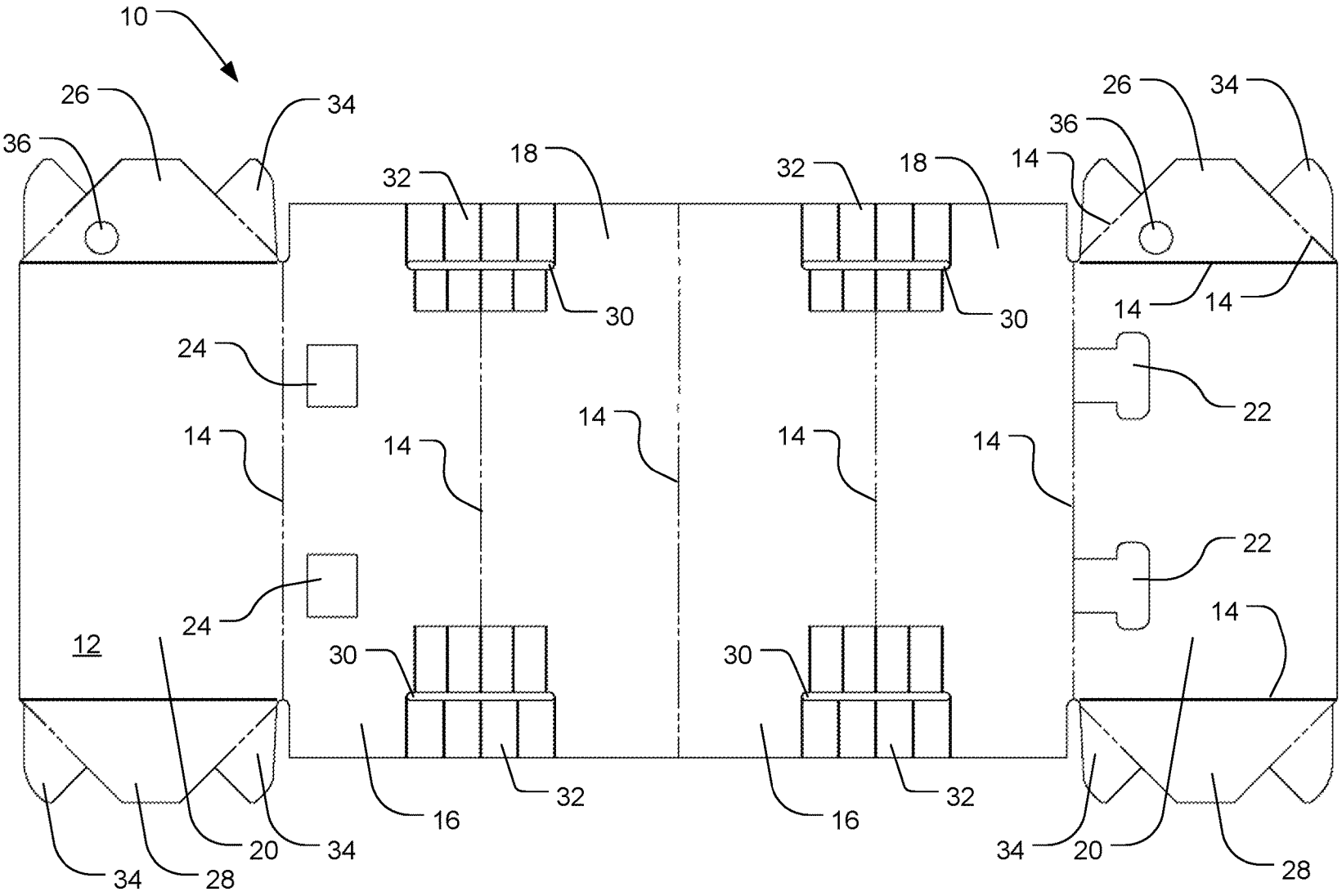
FIG. 1 shows a plan (flat, unfolded) view of an exemplary shipping article.

A description of embodiments of the present invention will now be given with reference to the Figures. It is expected that the present invention may take many other forms and shapes, hence the following disclosure is intended to be illustrative and not limiting, and the scope of the invention should be determined by reference to the appended claims.

Certain embodiments of the invention provide an improved shipping article including a single piece of substantially planar material with parallel scores formed therein thereby defining six substantially planar sections of the shipping article, the six planar sections of the shipping article defining, when the piece of substantially planar material is folded along the parallel scores, a first pair of opposing, substantially parallel, spaced-apart sides, a second pair of opposing, substantially parallel, spaced-apart sides that are substantially perpendicular to the first pair of sides, and a pair of dividing walls located adjacent each other and dividing a compartment formed by the first and second pairs of sides into two sub-compartments. Each of the planar sections defining the dividing walls includes a top extension sized and shaped to fold down to form a top of one of the sub-compartments. Each of the top extensions includes a hole therein sized to receive a human finger or thumb to facilitate lifting of the shipping article by the top extensions during insertion of or removal of the shipping article from a secondary shipping container.

In some embodiments, the parallel scores further define a seventh substantially planar section of the shipping article. When the piece of substantially flat material is folded along the parallel scores, two of the planar sections of the shipping article jointly form one of the two of the first pair of opposing, substantially parallel, spaced-apart sides. A single third planar section of the shipping article forms the other of the first pair of opposing, substantially parallel, spaced-apart sides. In some of such embodiments, the sub-compartments have a substantially rectangular cross-section when taken substantially perpendicular to the material of the sides. In some of such embodiments, the sub-compartments have a substantially square cross-section when taken substantially perpendicular to the material of the sides. In some of such embodiments, each of the planar sections defining the dividing walls further includes a bottom extension sized and shaped to fold up to form a bottom of one of the sub-compartments. The substantially planar material further includes a plurality of slits extending between adjacent sides of the first and second pairs of sides separating portions thereof above and below the top and the bottom of the sub-compartments, thereby permitting the portions above and below the top and the bottom of the sub-compartments to be inwardly displaced after the piece of substantially planar material is folded and the tops and the bottoms of the sub-compartments are folded down and up, respectively, to hold the tops and the bottoms of the sub-compartments in place. In some of such embodiments, the piece of substantially planar material includes two of the plurality of slits for each top and for each bottom of the sub-compartments.

In some embodiments, each of the planar sections defining the dividing walls further includes a bottom extension sized and shaped to fold up to form a bottom of one of the sub-compartments. The substantially planar material further includes a plurality of slits extending between adjacent sides of the first and second pairs of sides separating portions thereof above the tops and below the bottoms of the sub-compartments, thereby permitting the portions above the tops and below the bottoms of the sub-compartments to be inwardly displaced after the piece of substantially planar material is folded and the tops and the bottoms of the sub-compartments are folded down and up, respectively, to hold the tops and the bottoms of the sub-compartments in place.

In some embodiments, one or more of the sides of the first pair of opposing sides or the second pair of opposing sides includes an item-separating shelf formed as a portion of the single piece of substantially planar material detached from its respective side except along a line substantially perpendicular to the parallel scores, whereby the shelf is adapted to fold into one of the sub-compartments to separate such sub-compartment into vertically spaced sub-sub-compartments. In some of such embodiments, the shipping article includes item-separating shelves such as two item-separating shelves separating the two sub-compartments into four sub-sub-compartments, four item-separating shelves separating the two sub-compartments into six sub-sub-compartments, six item-separating shelves separating the two sub-compartments into eight sub-sub-compartments.

In some embodiments, the single piece of material includes or is corrugated cardboard. In some embodiments, the sub-compartments are sized to receive items such as wine bottles, aluminum beverage cans, beverage bottles, beverage growlers, beverage crowlers, and beverage bombers. In some embodiments, when the shipping article is folded, the shipping article contains and protects two or more items in the sub-compartments between the tops and bottoms formed by bottom extensions sized and shaped to fold up from the planar sections defining the dividing walls. When the shipping article is located within an external box that encloses the shipping article, the external box and the shipping article form a first crush void above the tops, and a second crush void below the bottoms, the first and second crush voids being defined by portions of the first and second pairs of opposing sides that extend beyond the bottoms and the tops.

According to some embodiments, an improved shipping article includes a single piece of substantially planar material with parallel scores formed therein thereby defining seven substantially planar sections of the shipping article, the seven planar sections of the shipping article defining, when the piece of substantially planar material is folded along the parallel scores, a first pair of opposing, substantially parallel, spaced-apart sides, one of the first pair of sides being formed of a single of the planar sections and the other of the first pair of sides being formed of two other of the planar sections, a second pair of opposing, substantially parallel, spaced-apart sides that are substantially perpendicular to the first pair of sides, and a pair of dividing walls located adjacent each other and dividing a compartment formed by the first and second pairs of sides into two sub-compartments. Each of the planar sections defining the dividing walls includes a top extension sized and shaped to fold down to form a top of one of the sub-compartments, and a bottom extension sized and shaped to fold up to form a bottom of one of the sub-compartments.

In some embodiments, each of the top extensions includes a hole therein sized to receive a human finger or thumb to facilitate lifting of the shipping article by the top extensions during insertion of or removal of the shipping article from a secondary shipping container. In some embodiments, the sub-compartments have a substantially square cross-section when taken substantially perpendicular to the material of the sides. In some embodiments, the substantially planar material further includes two slits for each bottom of the sub-compartments and for each top of the sub-compartments, the slits extending between adjacent sides of the first and second pairs of sides separating portions thereof above and below the top and the bottom of the sub-compartments, thereby permitting the portions above the tops and below the bottoms of the sub-compartments to be inwardly displaced after the piece of substantially planar material is folded and the tops and the bottoms of the sub-compartments are folded down and up, respectively, to hold the tops and the bottoms of the sub-compartments in place.

In some embodiments, one or more of the sides of the first pair of opposing sides or the second pair of opposing sides includes an item-separating shelf formed as a portion of the single piece of substantially planar material detached from its respective side except along a line substantially perpendicular to the parallel scores, whereby the shelf is adapted to fold into one of the sub-compartments to separate such sub-compartment into vertically spaced sub-sub-compartments. In some of such embodiments, the shipping article includes item-separating shelves such as two item-separating shelves separating the two sub-compartments into four sub-sub-compartments, four item-separating shelves separating the two sub-compartments into six sub-sub-compartments, six item-separating shelves separating the two sub-compartments into eight sub-sub-compartments.

In some embodiments, the single piece of material includes or is corrugated cardboard. In some embodiments, the sub-compartments are sized to receive items such as wine bottles, aluminum beverage cans, beverage bottles, beverage growlers, beverage crowlers, and beverage bombers. In some embodiments, when the shipping article is folded, the shipping article contains and protects two or more items in the sub-compartments between the tops and bottoms formed by bottom extensions sized and shaped to fold up from the planar sections defining the dividing walls. When the shipping article is located within an external box that encloses the shipping article, the external box and the shipping article form a first crush void above the tops, and a second crush void below the bottoms, the first and second crush voids being defined by portions of the first and second pairs of opposing sides that extend beyond the bottoms and the tops.

According to some embodiments, an improved shipping article includes a single piece of substantially planar material with parallel scores formed therein thereby defining six substantially planar sections of the shipping article, the six planar sections of the shipping article defining, when the piece of substantially planar material is folded along the parallel scores, a first pair of opposing, substantially parallel, spaced-apart sides, a second pair of opposing, substantially parallel, spaced-apart sides that are substantially perpendicular to the first pair of sides, and a pair of dividing walls located adjacent each other and dividing a compartment formed by the first and second pairs of sides into two sub-compartments. Each of the planar sections defining the dividing walls includes a top extension sized and shaped to fold down to form a top of one of the sub-compartments and a bottom extension sized and shaped to fold up to form a bottom of one of the sub-compartments. One or more of the sides of the first pair of opposing sides or the second pair of opposing sides includes an item-separating shelf formed as a portion of the single piece of substantially planar material detached from its respective side except along a line substantially perpendicular to the parallel scores, whereby the shelf is adapted to fold into one of the sub-compartments to separate such sub-compartment into vertically spaced sub-sub-compartments.

In some embodiments, the parallel scores further define a seventh substantially planar section of the shipping article, wherein when the piece of substantially flat material is folded along the parallel scores, two of the planar sections of the shipping article jointly form one of the two of the first pair of opposing, substantially parallel, spaced-apart sides, and a single third planar section of the shipping article forms the other of the first pair of opposing, substantially parallel, spaced-apart sides. In some of such embodiments, the sub-compartments have a substantially square cross-section when taken substantially perpendicular to the material of the sides. In some of such embodiments, each of the planar sections defining the dividing walls further includes a bottom extension sized and shaped to fold up to form a bottom of one of the sub-compartments. The substantially planar material further includes a plurality of slits extending between adjacent sides of the first and second pairs of sides separating portions thereof above and below the top and the bottom of the sub-compartments, thereby permitting the portions above and below the top and the bottom of the sub-compartments to be inwardly displaced after the piece of substantially planar material is folded and the tops and the bottoms of the sub-compartments are folded down and up, respectively, to hold the tops and the bottoms of the sub-compartments in place. In some of such embodiments, the piece of substantially planar material includes two of the plurality of slits for each top and for each bottom of the sub-compartments.

In some embodiments, each of the top extensions includes a hole therein sized to receive a human finger or thumb to facilitate lifting of the shipping article by the top extensions during insertion of or removal of the shipping article from a secondary shipping container. In some embodiments, the substantially planar material further includes a plurality of slits extending between adjacent sides of the first and second pairs of sides separating portions thereof above the tops and below the bottoms of the sub-compartments, thereby permitting the portions above the tops and below the bottoms of the sub-compartments to be inwardly displaced after the piece of substantially planar material is folded and the tops and the bottoms of the sub-compartments are folded down and up, respectively, to hold the tops and the bottoms of the sub-compartments in place.

In some embodiments, the shipping article includes item-separating shelves such as two item-separating shelves separating the two sub-compartments into four sub-sub-compartments, four item-separating shelves separating the two sub-compartments into six sub-sub-compartments, six item-separating shelves separating the two sub-compartments into eight sub-sub-compartments.

In some embodiments, the single piece of material includes or is corrugated cardboard. In some embodiments, the sub-compartments are sized to receive items such as wine bottles, aluminum beverage cans, beverage bottles, beverage growlers, beverage crowlers, and beverage bombers. In some embodiments, when the shipping article is folded, the shipping article contains and protects two or more items in the sub-compartments between the tops and bottoms formed by bottom extensions sized and shaped to fold up from the planar sections defining the dividing walls. When the shipping article is located within an external box that encloses the shipping article, the external box and the shipping article form a first crush void above the tops, and a second crush void below the bottoms, the first and second crush voids being defined by portions of the first and second pairs of opposing sides that extend beyond the bottoms and the tops.

The Figures illustrate various embodiments of improved shipping articles 10. FIG. 1 illustrates a plan/flat view of a first embodiment of the shipping article 10 in its flat, unfolded state. The shipping article 10 is formed of a single piece of substantially planar material 12. After initial forming of the shipping article 10 (e.g., by cutting, scoring, folding, and the like), the shipping article 10 may not be naturally strictly planar. In other words, the formed shipping article may be prone to bending at any score lines, for example. Additionally, the material 12, prior to forming of the shipping article 10, may have some not strictly planar portions (e.g., due to natural undulations or the like), but the material 12 should still be viewed as being "substantially planar."

In certain embodiments, the substantially planar material 12 is a paperboard or a plastic board product. In some exemplary embodiments, the substantially planar material 12 is a corrugated paperboard product such as 40 edge crush test (40 ECT) or some other strength corrugated board. The strength of the substantially planar material 12, in some embodiments, is selected to allow the shipping article 10 to support the weight load of the anticipated contents of the shipping article 10. The shipping article 10 may be formed of any desired substantially planar material 12 as long as the shipping article 10 so formed satisfies desired strength, durability, weight, cost, and/or other characteristics, and one of ordinary skill in the art will be able to determine appropriate materials or alternate materials for the substantially planar material 12.

In some embodiments, the material 12 is pre-readied for being formed into the shipping article 10 by a process of cutting, perforating, scoring and/or pre-folding the material 12. In other embodiments, the shipping article 10 formation process also includes a step of forming the substantially planar material 12, which may include a first step of cutting or forming the substantially planar material 12 in the overall shape of the finished shipping article 10, which is then further formed by cutting, perforating, scoring, creasing, and/or folding the material. In certain embodiments, the material 12 is formed into the shipping article 10 at a manufactory while retaining its substantially planar configuration. The shipping article 10 is then transported (e.g., shipped) to an end user (e.g., as a stack of substantially planar shipping articles 10). The end user then folds the material 12 along pre-formed score lines 14 or creases to form the folded shipping article 10 ready to receive contents for shipping.

The score lines 14 formed in the material 12 define substantially planar sections of the shipping article 10 that are formed when the material 12 is folded by the end user. A series of substantially parallel score lines 14 divide the material 12 into sides and dividing walls of the shipping article 10 in the embodiment of FIG. 1. In particular, the parallel score lines 14 divide the material 12 into a first pair of sides 16, a second pair of sides 18, and a pair of dividing walls 20. When the shipping article 10 is folded into its folded configuration, the first sides 16 are arranged to be substantially parallel to each other and are spaced apart to define an enclosed volume. Similarly, when the shipping article 10 is folded into its folded configuration, the second sides 18 are arranged to be substantially parallel to each other and are spaced apart to further define and enclose the enclosed volume. The second sides 18 in at least some embodiments are generally or substantially perpendicular to the first sides 16 (i.e., the bends at the score lines 14 are substantially right angles), when the shipping article 10 is in its folded configuration, such that the enclosed volume defined by the first sides 16 and the second sides 18 is generally that of a rectangular prism.

Figure 2:
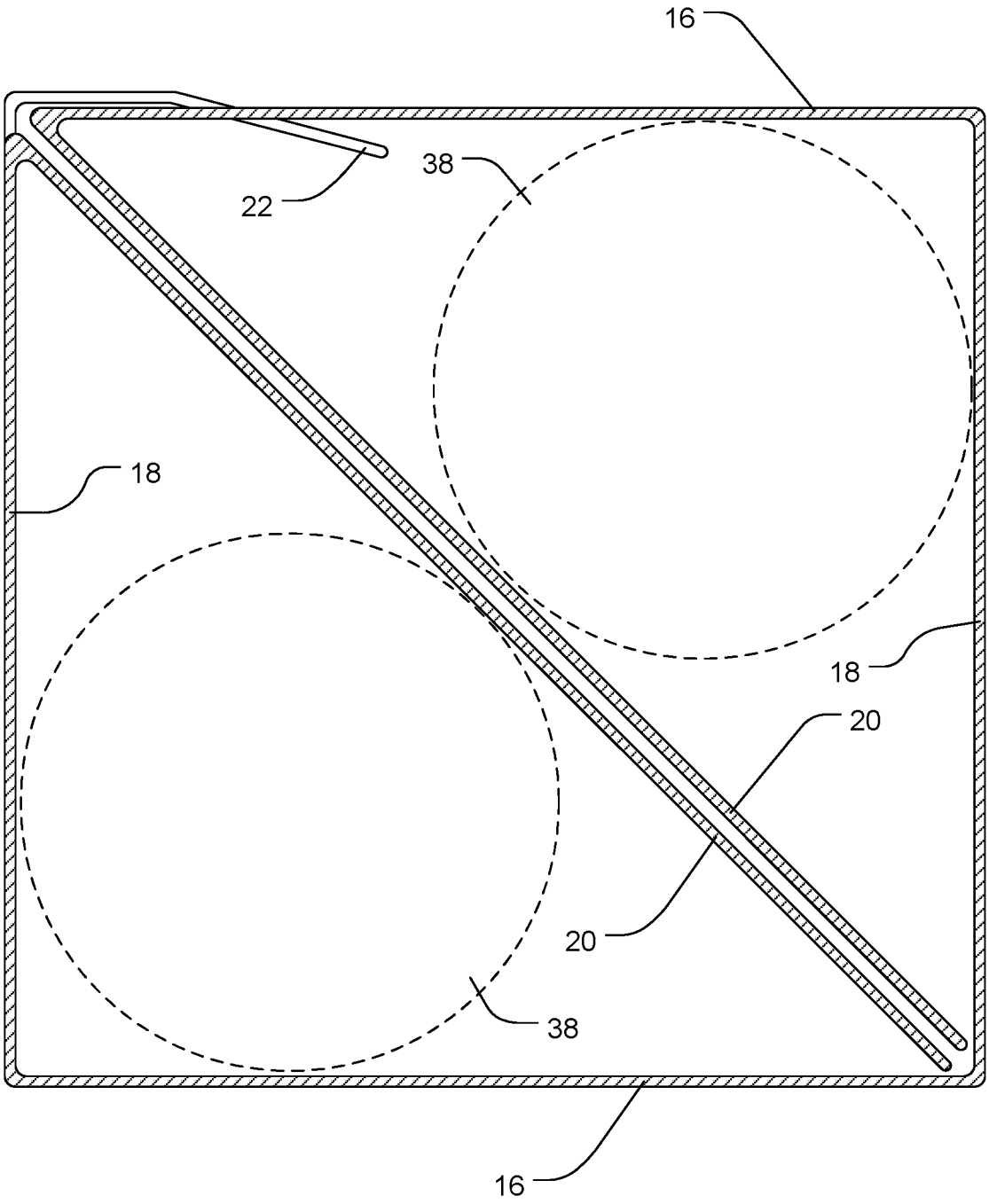
FIG. 2 shows a top-down cross sectional view of the shipping article of FIG. 1 in a partially folded state.

When the shipping article 10 is in its folded configuration, the two dividing walls 20 are located immediately adjacent to each other within the enclosed volume. The dividing walls 20 extend between opposite corners of the shipping article 10 such that the dividing walls 20 divide the enclosed volume (generally shaped as a rectangular prism) along its length into two sub-volumes that, in this embodiment, have a general shape of a triangular prism. FIG. 2 illustrates a illustrative cross-sectional view of the shipping article 10 of FIG. 1 in its partially folded configuration after the material 12 has been folded along the parallel score lines 14 to encompass the two generally triangular-prism-shaped sub-volumes making up the enclosed volume. The view of FIG. 2 is not necessarily to scale to facilitate illustrating the functionality of the folding of the material 12 to form the shipping article 10. By way of the folding of the material 12 in the manner shown in FIG. 2, the first sides 16 and the second sides 18 form a compartment that is divided into two sub-compartments by the dividing walls 20.

When the material 12 is initially formed, one or more locking tabs 22 (two are illustrated in the embodiment of FIG. 1) are cut into the material 12 such that the locking tabs 22 are formed from the material of one of the dividing walls 20 such that the locking tabs 22 thereby effectively form an extension of the material of one of the first sides 16 or one of the second sides 18 (as in the embodiment of FIG. 1). Corresponding locking slots 24 or locking holes are also cut into one of the second sides 18 or one of the first sides 16 (of a type of side 16, 18 different than the side 16, 18 from which the one or more locking tabs 22 extend). The one or more corresponding locking slots 24 are located in the side 16, 18 proximate the other of the dividing walls 20 and positioned such that when the material 12 is folded into the partially folded configuration of FIG. 2, the locking tabs 22 will be located immediately adjacent the locking slots, can be wrapped around the corner where the dividing walls 20 meet, and can be pushed into the locking slots 24. Pushing the locking tabs 22 into the locking slots 24 secures the material 12 in the partially-folded state, as is also seen in FIG. 2.

The shipping article 10, as originally formed in its substantially planar state, also includes score lines 14 on each of the dividing walls 20 that are substantially perpendicular to the series of parallel score lines 14 discussed previously. These perpendicular score lines 14 delineate end portions of the dividing walls that form a top extension 26 and a bottom extension 28 of each dividing wall 20. The top extensions 26 and the bottom extensions 28 serve to be folded to form tops and bottoms, respectively, of each of the sub-compartments, as shown in top-down perspective view of FIG. 3 (only the top extensions 26 are shown in this view). Corresponding extension-securing slits 30 are formed extending between adjacent first sides 16 and second sides 18, such that the slits 30 are disposed opposite the dividing walls 20 when the shipping article 10 is in its folded state. The slits 30 serve to separate a portion of the adjacent first sides 16 and second sides 18 above upper slits 30 and below lower slits 30 such that the separated portion can be displaced inwardly toward the dividing walls 20 after the top extension 26 are folded down and the bottom extensions 28 are folded up, thereby forming retaining members 32. The retaining members 32 hold the top extensions 26 and the bottom extensions 28 in their folded position whereby they form secure tops and bottoms to the sub-compartments.

Figure 3:
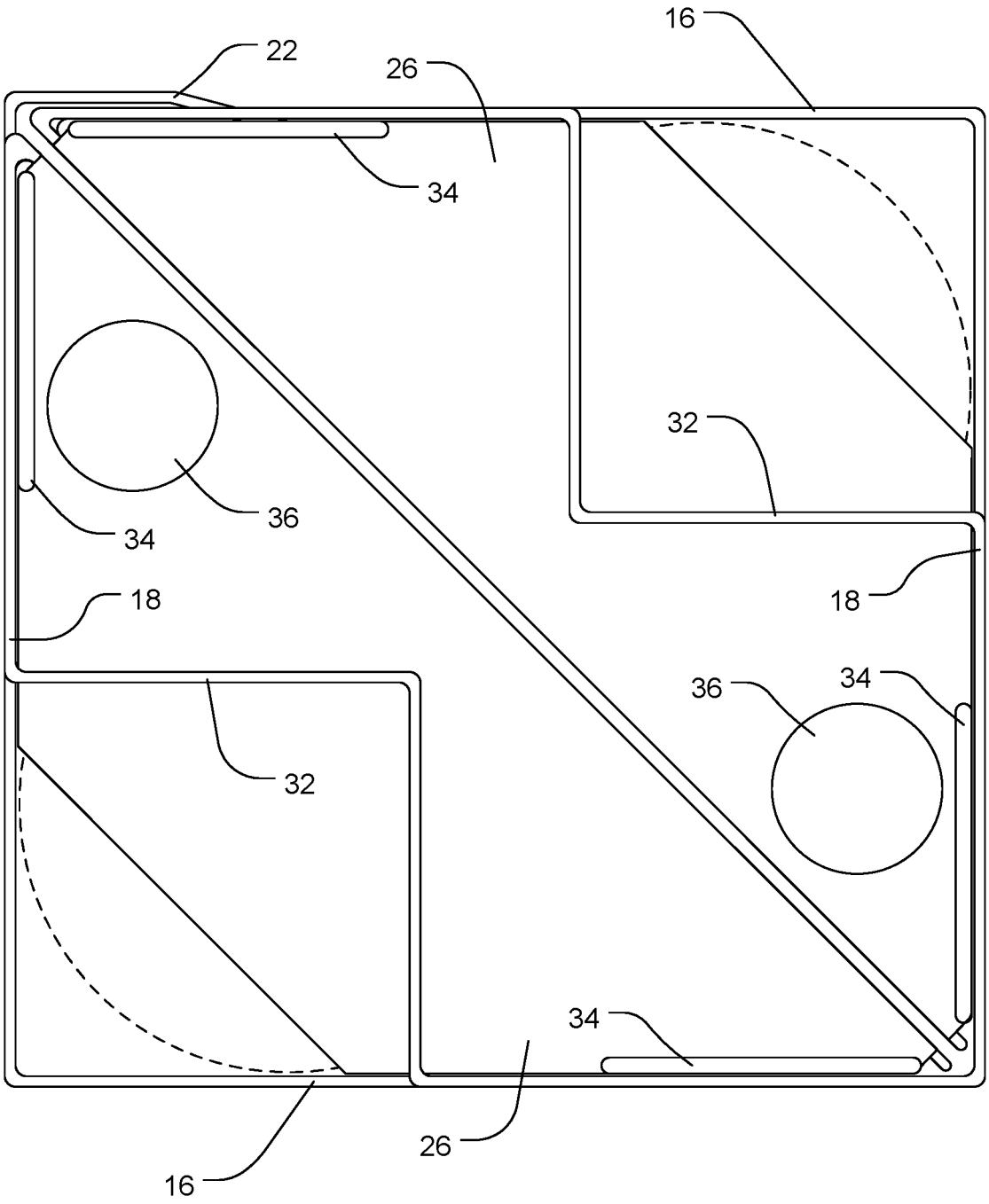
FIG. 3 shows a top-down perspective view of the shipping article of FIG. 1 in a fully folded state.

In some embodiments, as illustrated in FIGS. 1 and 3, the top extensions 26 and the bottom extensions 28 each include tabs 34 joined to the respective extension 26, 28 at further score lines 14. The tabs 34 fold up adjacent to the first sides 16 and the second sides 18, as shown in FIG. 3, when the top extensions 26 and the bottom extensions 28 are folded inward, thereby providing additional strength to the top extensions 26 and the bottom extensions 28.

In certain embodiments, as also illustrated in FIGS. 1 and 3, the top extensions 26 each include a hole 36 sized to receive a finger or thumb therethrough. When the shipping article 10 is in its fully folded shape as shown in FIG. 3, the holes 36 are adapted and positioned to permit a user to insert a thumb and finger into the holes 36, whereby the user can lift the shipping article 10 (with any items contained in the sub-compartments) into or out of a secondary shipping container. In some embodiments, the secondary shipping container is a separate shipping article sized to receive a single shipping article 10 therein with its contents. In other embodiments, the secondary shipping container is sized to receive multiple of the shipping articles 10 therein with their contents. Regardless, the placement of the holes 36 greatly facilitates such placement and removal.

The secondary shipping container serves to provide further protection to the contents of the shipping article 10. In particular, two layers of protection are formed around all outer sides of the sub-compartments, and there are two layers of protection between the sub-compartments provided by the dividing walls 20. Furthermore, the top extensions 26 and the bottom extensions 28 forming the tops and bottoms of the sub-compartments, respectively, provide a space above and below the sub-compartments within the secondary shipping container. Accordingly, the contents of the sub-compartments are further protected against impacts to the secondary container, especially at the corners thereof, where damage is most likely to occur.

The shipping article 10 as illustrated in FIGS. 1-3 is especially adapted to protect fragile items, such as wine and alcohol bottles and other beverage containers such as beer cans and the like during shipping. As particularly illustrated in FIG. 2, the individual contents 38 of the shipping article 10 may have a generally circular maximum cross-sectional dimension that fits generally snugly within the sub-compartments and is protected by the shipping article 10. The shipping article of FIGS. 1-3 is generally adapted to secure two items during shipping, although it may be used to secure more than two items if such items are not prone to breakage.

Figure 4:
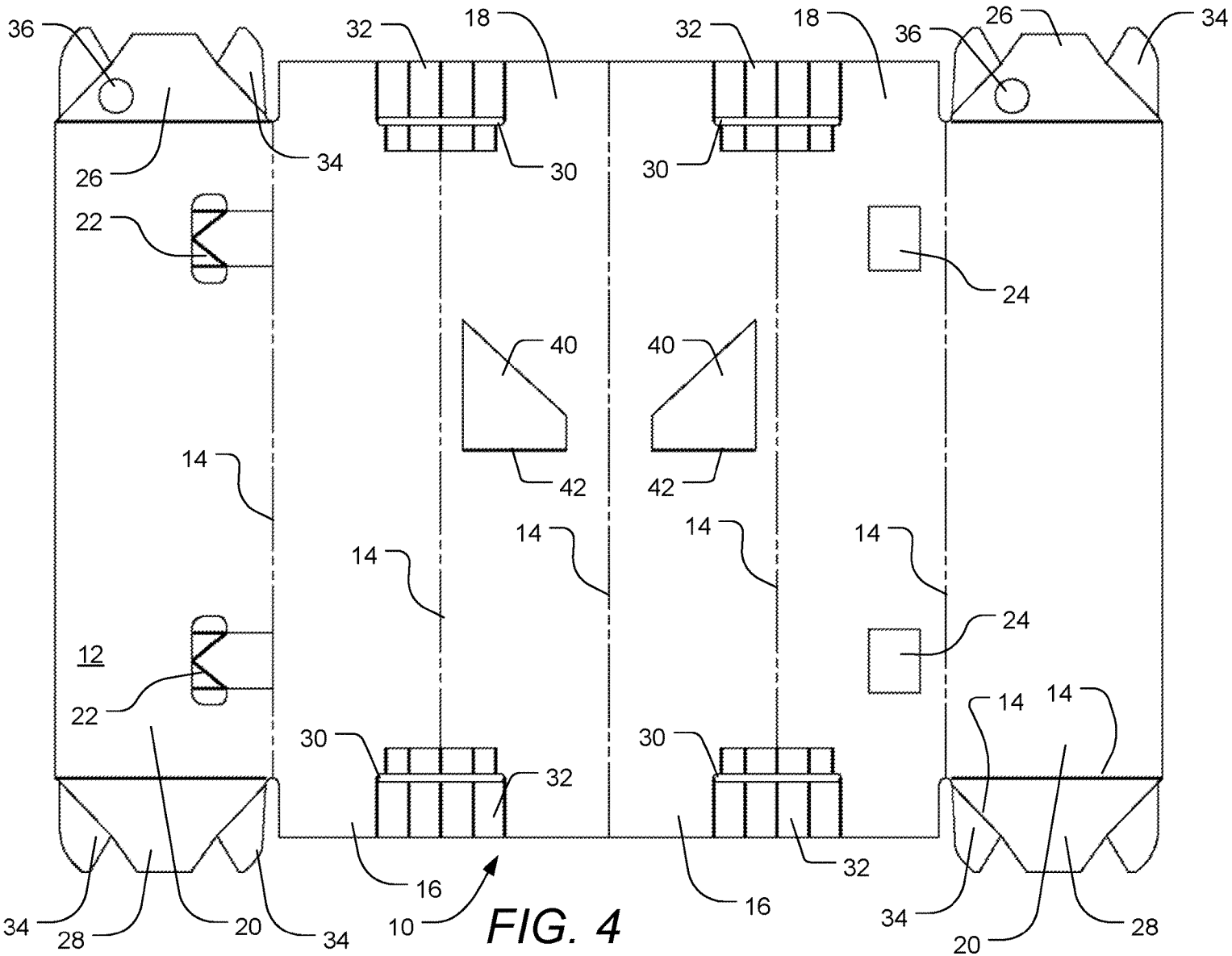
FIG. 4 shows a plan (flat, unfolded) view of an alternate exemplary shipping article.

Alternate embodiments of the shipping article 10 are adapted to receive more than two items for shipping while still providing separation and protection to all items contained in the shipping article. In particular, FIG. 4 illustrates a plan/flat view of one alternate embodiment of the shipping article 10. This embodiment is adapted to contain four items during shipping while protecting such items both from externally caused damage and damage between items. In the embodiment illustrated in FIG. 4, the shipping article 10 is adapted to form two sub-compartments as discussed with respect to the embodiment of FIGS. 1-3, but is further adapted to divide each sub-compartment vertically into two sub-sub-compartments.

The sub-compartment separation into sub-sub-compartments is achieved by way of item-separating shelves 40 that are formed from the unitary sheet of material 12 and are cut along all but one edge 42 thereof so to be separated from the respective first side 16 or second side 18 where they are located. A score or crease is optionally formed at the remaining edge 42 to facilitate folding of each shelf 40 into the sub-compartment. When the shelf 40 is folded into the sub-compartment, as shown in the cross-sectional view of FIG. 5, the shelf 40 extends in a plane generally perpendicular to the planes of the first sides 16 and second sides 18, and occupies a major portion of the sub-compartment, thereby serving to protect objects in one sub-sub-compartment against impacts from objects in the other, adjacent, sub-sub compartment. As may be appreciated, appropriate sizing of the sub-sub-compartments can be used to minimize shifting or movement of the contents of the shipping article 10 therein such that the protection afforded by the shelves 40 is adequate to protect the contents.

Figure 5:
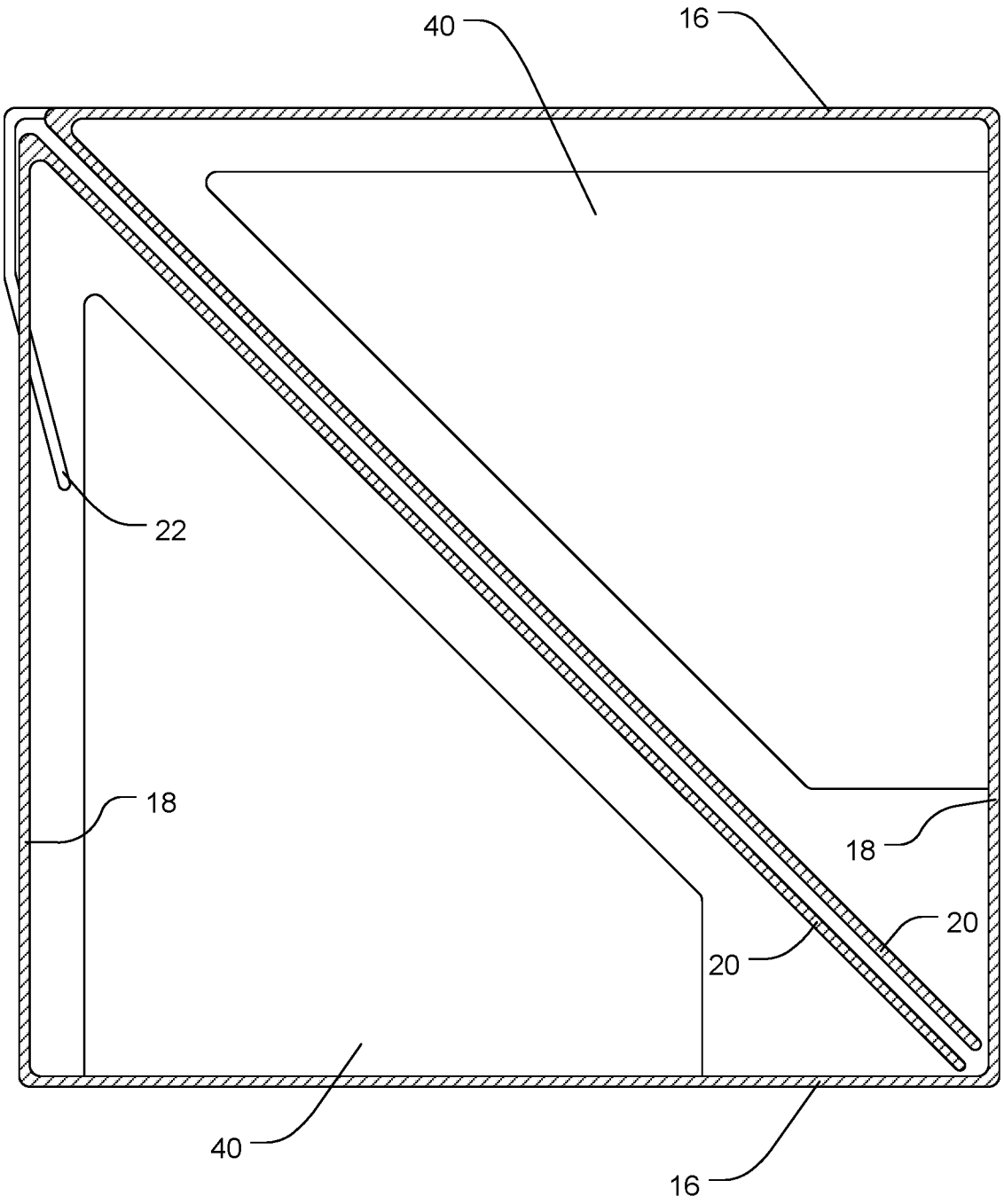
FIG. 5 shows a top-down cross-sectional view of the shipping article of FIG. 4 in a partially folded state.

As may be appreciated by comparing the embodiment of FIGS. 1-3 with the embodiment of FIGS. 4-5, the shipping article 10, when folded, is taller to accommodate a stack of two items in each sub-compartment when similar items are contained therein. One of ordinary skill in the art can readily appreciate the variations in sizes that may be used to accommodate a variety of items of varying sizes and of varying numbers.

Figure 6:
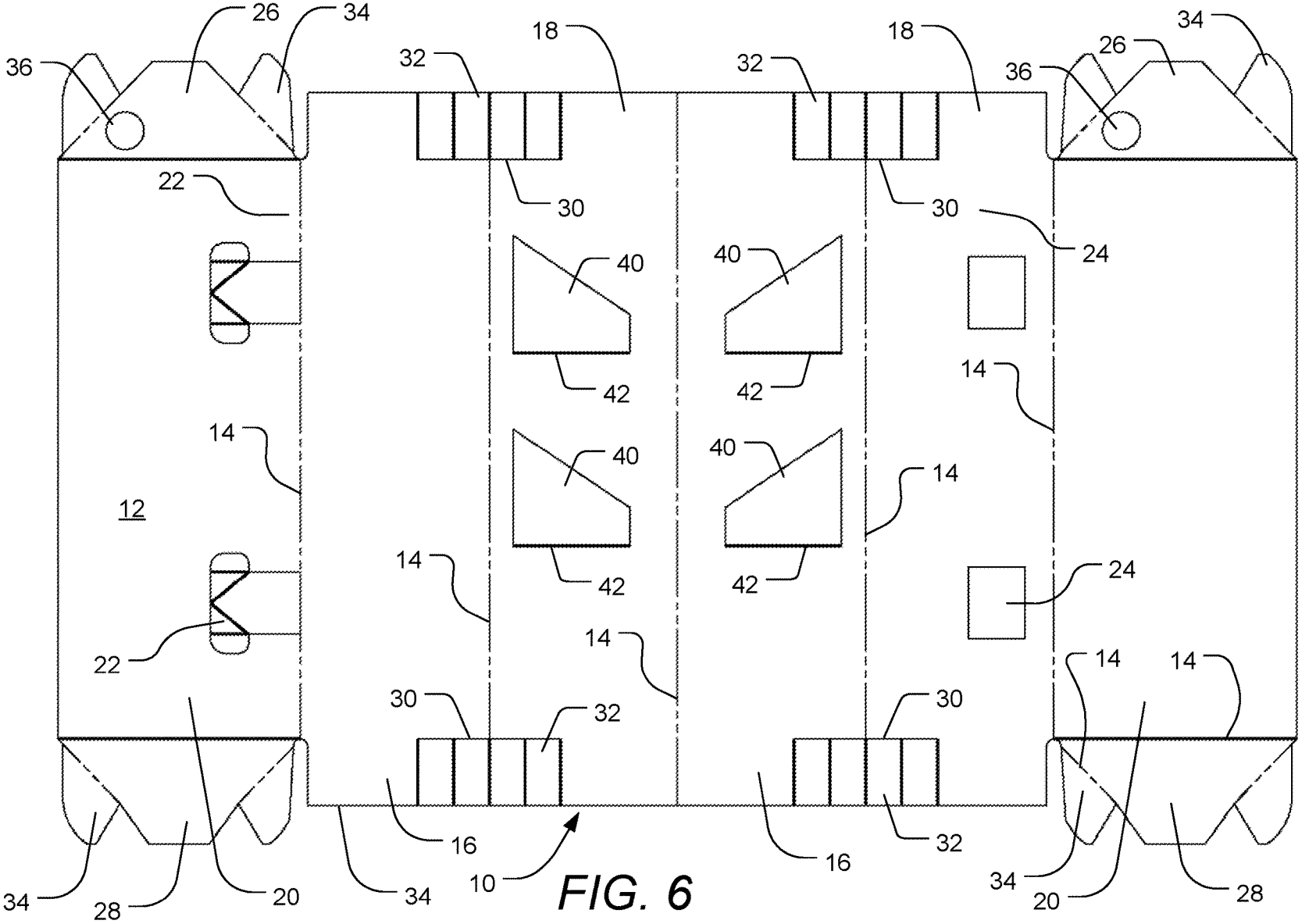
FIG. 6 shows a plan (flat, unfolded view of an alternate exemplary shipping article.

While the embodiment of FIGS. 1-3 is adapted to contain two items (e.g., two wine bottles) and the embodiment of FIGS. 4-5 is adapted to contain four items (e.g., four beer bottles in the illustrated embodiment, but potentially four cans of beer, four wine bottles, or other beverage, etc., as sized and adapted), other embodiments are possible. Indeed, FIG. 6 illustrates an embodiment adapted to contain six items (e.g., six cans of beer or other beverage). Other than variations in sizing, the embodiment of FIG. 6 is similar in features to the embodiment of FIGS. 4-5. The primary difference is in the number and placement of the item-separating shelves 40. In the embodiment of FIG. 4, the edges 42 are vertically centrally placed on their respective first side 16 and second side 18, thereby vertically dividing the shipping article equally into two sub-sub-compartments between the slits 30. In the embodiment of FIG. 6, the edges 42 are spaced vertically on their respective first side 16 and second side 18 at thirds between the slits 30. This placement thus divides each sub-compartment equally in thirds between the slits 30 into three sub-sub-compartments. As may be appreciated, the respective cross-sectional view of FIG. 5 could be equally applicable to the embodiment of FIG. 6 as to the embodiment of FIG. 4.

While 1-6 illustrate embodiments of the shipping article 10 having certain numbers and relative sizes of sub-sub-compartments, it should be understood that embodiments of the shipping article 10 are not limited to the embodiments illustrated in the Figures. Some embodiments of the shipping article 10 have differing numbers of sub-sub-compartments for each sub-compartment. Some embodiments of the shipping article 10 have only a single sub-compartment on one side, and multiple sub-sub-compartments on the other side. Other embodiments of the shipping article 10 have more than the six sub-sub-compartments illustrated in FIG. 6. Other embodiments of the shipping article 10 have sub-sub-compartments with different proportions than those illustrated in FIGS. 1-6.

The embodiments of the shipping article 10 illustrated in FIGS. 4-6 include embodiments of the finger hole 36. As with the embodiment of the shipping article 10 illustrated in FIGS. 1-3, the Finger holes 36 may be used by an end user to facilitate placement of the shipping article 10 into a secondary shipping container or by a purchaser to facilitate removal of the shipping article 10 from the secondary shipping container. Alternate embodiments of the shipping article 10 are sized similarly to the embodiments of the shipping article 10 shown in FIGS. 4-6, and include the shelves 40, but lack the finger holes 36. In such embodiments, placement of the shipping article 10 into or removal of the shipping article 10 from the secondary container is achieved by other means (such as by grasping the retaining members 32, by holding the exterior of the shipping article 10, or, in the case of removal, by tilting the secondary shipping container).

Figure 7:
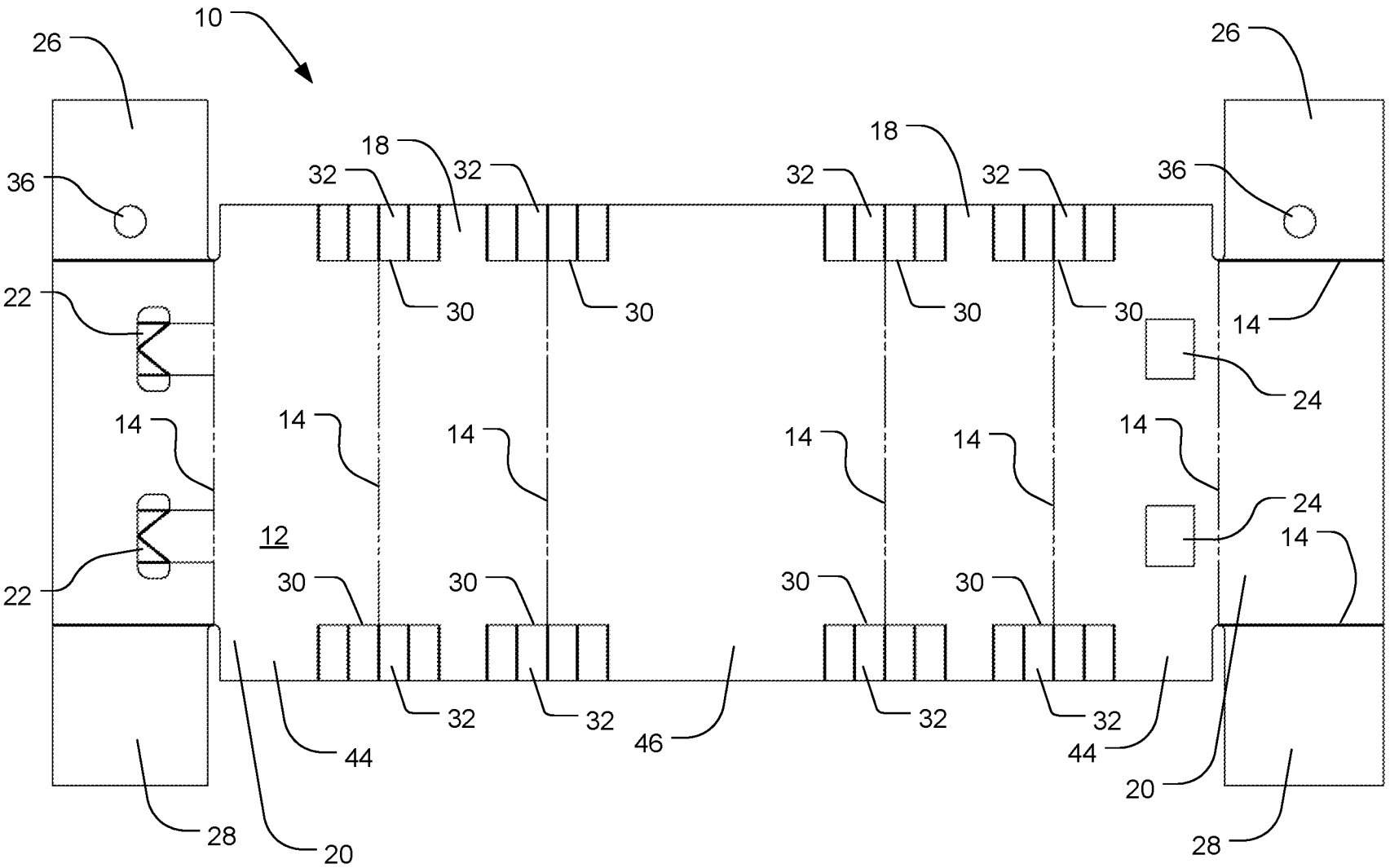
FIG. 7 shows a plan (flat, unfolded) view of an alternate exemplary shipping article.
Figure 8:
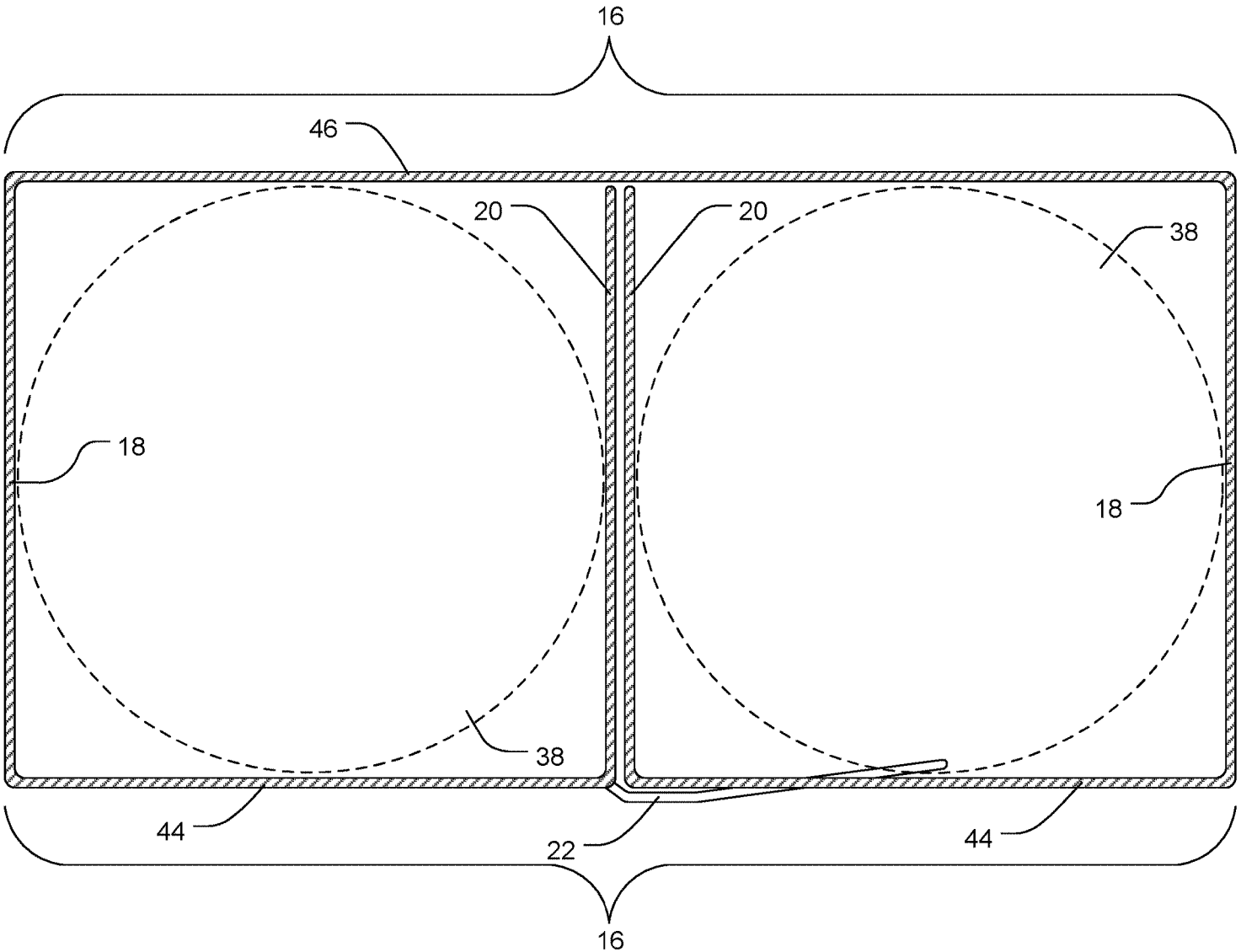
FIG. 8 shows a top-down cross sectional view of the shipping article of FIG. 7 in a partially folded state.
Figure 9:
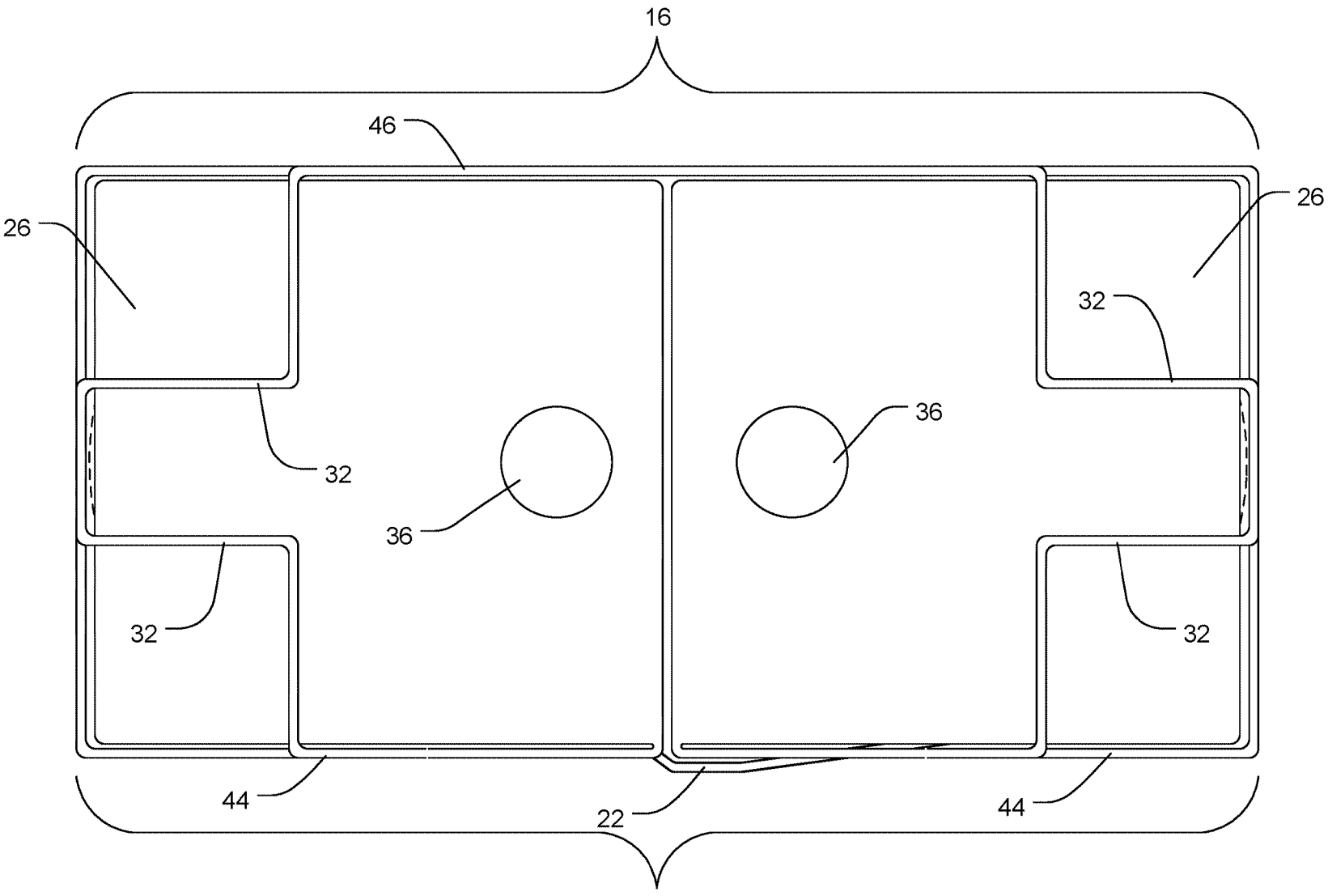
FIG. 9 shows a top-down perspective view of the shipping article of FIG. 7 in a fully folded state.

Another style of shipping article 10 is illustrated in FIGS. 7-9. The embodiment of the shipping article 10 shown in these Figures may be particularly adapted to shipping articles having a slightly larger diameter, including larger beverage containers such as growlers, crowlers, or bombers; however, versions of the shipping article 10 having features similar to the embodiment illustrated in FIGS. 7-9 may be provided and sized to receive any size of contents. Similarly, while the embodiment illustrated in FIGS. 7-9 is adapted to receive two articles for shipping, further alternate embodiments may be provided for containing and shipping additional articles by altering the dimensions of the shipping article 10 and providing shelves 40 similar to those illustrated in FIGS. 4-6.

In the embodiment illustrated in FIGS. 1-6, the shipping article 10 is generally divided into six substantially planar sections that make up the first and second sides 16, 18, and the dividing walls 20. In the embodiment illustrated in FIGS. 7-9, the shipping article 10 is generally divided into seven substantially planar sections that collectively make up the first and second sides 16, 18, and the dividing walls 20. In this instance, however, one of the first sides 16 is collectively made up of or formed by two smaller sections 44 of the substantially planar sections, while the other of the first sides 16 is made up of a single, centrally positioned, larger section 46 of the substantially planar sections.

Accordingly, when the shipping article 10 of this embodiment is folded into its folded position, the first and second sides 16, 18, and the dividing walls 20 form encompass a volume shaped in the general form of a rectangular prism and divide it into two sub-compartments each having a shape of a rectangular prism, as shown in the top-down cross-sectional view of FIG. 8 and the top-down perspective view of FIG. 9. As may be seen in FIGS. 7-9, the features of this embodiment of the shipping article 10 may be similar to and may serve functions similar to those features and functions discussed with previous embodiments. The shapes of certain portions may vary in accordance with the differing overall shape of the shipping article 10 of this embodiment, but it will be simple to understand the similar function from the foregoing description and appending drawings.

While the embodiment of FIGS. 7-9 includes finger holes 36 as did the embodiments shown in FIGS. 1-6, alternate embodiments similar in overall shape to the embodiment of FIGS. 7-9 (e.g., forming sub-compartments and/or sub-sub-compartments having a generally rectangular prism shape) lack the finger holes 36 shown in FIGS. 7-9. Additionally, while the illustrated embodiment of FIGS. 7-9 shows two retaining members formed from portions of the sides 16, 18 above and below the slits 30 for each top extension 26 and bottom extension 28, alternate embodiments of the shipping article 10 provide only a single retaining member 32 for each top extension 26 and/or bottom extension 28.

While one of ordinary skill in the art will be readily able to select and vary specific sizes of dimensions for the various parts of the various embodiments of the shipping article 10, illustrative dimensions of aspects of specific embodiments of the illustrated embodiments are now provided by way of example only, and not by way of limitation. In particular, turning to FIG. 1, in one embodiment, the shipping article (in its flat state) has a total width of approximately 40 inches (approximately 102 cm) and a total height of approximately 19.5 inches (approximately 49.5 cm). Each of the sides 16, 18, has a width of approximately 6 inches (approximately 15.2 cm) and a height of approximately 16.8 inches (approximately 42.7 cm). The dividing walls 20 each have a width of approximately 8 inches (approximately 20.3 cm) and a height (between the score lines) of approximately 13.25 inches (approximately 33.7 cm). The top and bottom extensions 26, 28 have a height of approximately 3.13 inches (approximately 7.25 cm). The finger holes 36 have a diameter of approximately 1 inch (approximately 2.5 cm).

Turning to FIG. 4, in one embodiment, the shipping article (in its flat state) has a total width of approximately 32.5 inches (approximately 82.6 cm) and a total height of approximately 24.75 inches (approximately 62.9 cm). Each of the sides 16, 18, has a width of approximately 4.9 inches (approximately 12.5 cm) and a height of approximately 22.75 inches (approximately 57.8 cm). The dividing walls 20 each have a width of approximately 6.4 inches (approximately 16.2 cm) and a height (between the score lines) of approximately 19.25 inches (approximately 48.9 cm). The top and bottom extensions 26, 28 have a height of approximately 2.75 inches (approximately 7.0 cm). The finger holes 36 have a diameter of approximately 1 inch (approximately 2.5 cm). The item-separating shelves 40 have a width of approximately 3.1 inches (approximately 7.8 cm).

Turning to FIG. 6, in one embodiment, the shipping article (in its flat state) has a total width of approximately 32.5 inches (approximately 82.6 cm) and a total height of approximately 20.7 inches (approximately 52.5 cm). Each of the sides 16, 18, has a width of approximately 4.9 inches (approximately 12.5 cm) and a height of approximately 18.7 inches (approximately 47.5 cm). The dividing walls 20 each have a width of approximately 6.4 inches (approximately 16.2 cm) and a height (between the score lines) of approximately 15.2 inches (approximately 38.6 cm). The top and bottom extensions 26, 28 have a height of approximately 2.75 inches (approximately 7.0 cm). The finger holes 36 have a diameter of approximately 1 inch (approximately 2.5 cm). The item-separating shelves 40 have a width of approximately 3.1 inches (approximately 7.8 cm). The item-separating shelves 40 are vertically spaced so as to create sub-sub-compartments having a height of approximately 5.1 inches (approximately 12.9 cm).

Turning to FIG. 7, in one embodiment, the shipping article (in its flat state) has a total width of approximately 41.4 inches (approximately 105.1 cm) and a total height of approximately 21.3 inches (approximately 54.1 cm). Each of the first sides 16 (and the larger section 46) has a width of approximately 10.5 inches (approximately 26.7 cm). Each of the second sides 18 has a width of approximately 5.25 inches (approximately 13.3 cm). Each of the smaller sections 44 has a width of approximately 5.1 inches (approximately 13.0 cm). The first and second sides 16, 18 and their respective sections 44, 46 have a height of approximately 14.8 inches (approximately 37.6 cm). The dividing walls 20 each have a width of approximately 5.1 inches (approximately 13.0 cm) and a height (between the score lines) of approximately 11.3 inches (approximately 28.7 cm). The top and bottom extensions 26, 28 have a height of approximately 5 inches (approximately 12.7 cm). The finger holes 36 have a diameter of approximately 1 inch (approximately 2.5 cm).

In each of the foregoing specifically-illustrated embodiments, the thickness of the material 12 is approximately ⅛ inch (approximately 0.1 inches or approximately 0.3 cm). As mentioned previously, the material 12 may be 40 ECT corrugated box material.

The present invention may be embodied in other specific forms without departing from its spirit or essential characteristics. The described embodiments are to be considered in all respects only as illustrative and not restrictive. The scope of the invention is, therefore, indicated by the appended claims, rather than by the foregoing description. All changes which come within the meaning and range of equivalency of the claims are to be embraced within their scope.

What is claimed and desired to be secured by Letters Patent is:

1. An improved shipping article comprising:

a single piece of substantially planar material with parallel scores formed therein thereby defining six substantially planar sections of the shipping article, the six planar sections of the shipping article defining, when the piece of substantially planar material is folded along the parallel scores:

a first pair of opposing, substantially parallel, spaced-apart sides;

a second pair of opposing, substantially parallel, spaced-apart sides that are substantially perpendicular to the first pair of sides; and a pair of dividing walls located adjacent each other and dividing a compartment formed by the first and second pairs of sides into two sub-compartments;

wherein each of the planar sections defining the dividing walls comprises a top extension sized and shaped to fold down to form a top of one of the sub-compartments, and wherein each of the top extensions comprises a hole therein sized to receive a human finger or thumb to facilitate lifting of the shipping article by the top extensions during insertion of or removal of the shipping article from a secondary shipping container.

2. The shipping article of claim 1, wherein the parallel scores further define a seventh substantially planar section of the shipping article, wherein when the piece of substantially flat material is folded along the parallel scores, two of the planar sections of the shipping article jointly form one of the two of the first pair of opposing, substantially parallel, spaced-apart sides, and a single third planar section of the shipping article forms the other of the first pair of opposing, substantially parallel, spaced-apart sides.

3. The shipping article of claim 2, wherein the sub-compartments have a substantially rectangular cross-section when taken substantially perpendicular to the material of the sides.

4. The shipping article of claim 2, wherein the sub-compartments have a substantially square cross-section when taken substantially perpendicular to the material of the sides.

5. The shipping article of claim 2, wherein:

each of the planar sections defining the dividing walls further comprises a bottom extension sized and shaped to fold up to form a bottom of one of the sub-compartments; and the substantially planar material further comprises a plurality of slits extending between adjacent sides of the first and second pairs of sides separating portions thereof above and below the top and the bottom of the sub-compartments, thereby permitting the portions above and below the top and the bottom of the sub-compartments to be inwardly displaced after the piece of substantially planar material is folded and the tops and the bottoms of the sub-compartments are folded down and up, respectively, to hold the tops and the bottoms of the sub-compartments in place.

6. The shipping article of claim 5, wherein the piece of substantially planar material comprises two of the plurality of slits for each top and for each bottom of the sub-compartments.

7. The shipping article of claim 1, wherein:

each of the planar sections defining the dividing walls further comprises a bottom extension sized and shaped to fold up to form a bottom of one of the sub-compartments; and the substantially planar material further comprises a plurality of slits extending between adjacent sides of the first and second pairs of sides separating portions thereof above the tops and below the bottoms of the sub-compartments, thereby permitting the portions above the tops and below the bottoms of the sub-compartments to be inwardly displaced after the piece of substantially planar material is folded and the tops and the bottoms of the sub-compartments are folded down and up, respectively, to hold the tops and the bottoms of the sub-compartments in place.

8. The shipping article of claim 1, wherein one or more of the sides of the first pair of opposing sides or the second pair of opposing sides comprises an item-separating shelf formed as a portion of the single piece of substantially planar material detached from its respective side except along a line substantially perpendicular to the parallel scores, whereby the shelf is adapted to fold into one of the sub-compartments to separate such sub-compartment into vertically spaced sub-sub-compartments.

9. The shipping article of claim 8, wherein the shipping article comprises item-separating shelves selected from the group consisting of:

two item-separating shelves separating the two sub-compartments into four sub-sub-compartments;

four item-separating shelves separating the two sub-compartments into six sub-sub-compartments; and six item-separating shelves separating the two sub-compartments into eight sub-sub-compartments.

10. The shipping article of claim 1, wherein the single piece of material comprises corrugated cardboard.

11. The shipping article of claim 1, wherein the sub-compartments are sized to receive items selected from the group consisting of:

wine bottles;

aluminum beverage cans;

beverage bottles;

beverage growlers;

beverage crowlers; and beverage bombers.

12. The shipping article of claim 1, wherein the shipping article is folded, wherein the shipping article contains and protects two or more items in the sub-compartments between the tops and bottoms formed by bottom extensions sized and shaped to fold up from the planar sections defining the dividing walls, and wherein the shipping article is located within an external box that encloses the shipping article, a first crush void above the tops, and a second crush void below the bottoms, the first and second crush voids being defined by portions of the first and second pairs of opposing sides that extend beyond the bottoms and the tops.

13. An improved shipping article comprising:

a single piece of substantially planar material with parallel scores formed therein thereby defining seven substantially planar sections of the shipping article, the seven planar sections of the shipping article defining, when the piece of substantially planar material is folded along the parallel scores:

a first pair of opposing, substantially parallel, spaced-apart sides, one of the first pair of sides being formed of a single of the planar sections and the other of the first pair of sides being formed of two other of the planar sections;

a second pair of opposing, substantially parallel, spaced-apart sides that are substantially perpendicular to the first pair of sides; and a pair of dividing walls located adjacent each other and dividing a compartment formed by the first and second pairs of sides into two sub-compartments;

wherein each of the planar sections defining the dividing walls comprises:

a top extension sized and shaped to fold down to form a top of one of the sub compartments; and a bottom extension sized and shaped to fold up to form a bottom of one of the sub-compartments.

14. The shipping article of claim 13, wherein each of the top extensions comprises a hole therein sized to receive a human finger or thumb to facilitate lifting of the shipping article by the top extensions during insertion of or removal of the shipping article from a secondary shipping container.

15. The shipping article of claim 13, wherein the sub-compartments have a substantially square cross-section when taken substantially perpendicular to the material of the sides.

16. The shipping article of claim 13, wherein the substantially planar material further comprises two slits for each bottom of the sub-compartments and for each top of the sub-compartments, the slits extending between adjacent sides of the first and second pairs of sides separating portions thereof above and below the top and the bottom of the sub-compartments, thereby permitting the portions above the tops and below the bottoms of the sub-compartments to be inwardly displaced after the piece of substantially planar material is folded and the tops and the bottoms of the sub-compartments are folded down and up, respectively, to hold the tops and the bottoms of the sub-compartments in place.

17. The shipping article of claim 13, wherein one or more of the sides of the first pair of opposing sides or the second pair of opposing sides comprises an item-separating shelf formed as a portion of the single piece of substantially planar material detached from its respective side except along a line substantially perpendicular to the parallel scores, whereby the shelf is adapted to fold into one of the sub-compartments to separate such sub-compartment into vertically spaced sub-sub-compartments.

18. An improved shipping article comprising:

a single piece of substantially planar material with parallel scores formed therein thereby defining six substantially planar sections of the shipping article, the six planar sections of the shipping article defining, when the piece of substantially planar material is folded along the parallel scores:

a first pair of opposing, substantially parallel, spaced-apart sides;

a second pair of opposing, substantially parallel, spaced-apart sides that are substantially perpendicular to the first pair of sides; and a pair of dividing walls located adjacent each other and dividing a compartment formed by the first and second pairs of sides into two sub-compartments;

wherein each of the planar sections defining the dividing walls comprises:

a top extension sized and shaped to fold down to form a top of one of the sub-compartments; and a bottom extension sized and shaped to fold up to form a bottom of one of the sub-compartments;

wherein one or more of the sides of the first pair of opposing sides or the second pair of opposing sides comprises an item-separating shelf formed as a portion of the single piece of substantially planar material detached from its respective side except along a line substantially perpendicular to the parallel scores, whereby the shelf is adapted to fold into one of the sub-compartments to separate such sub-compartment into vertically spaced sub-sub-compartments; and wherein the parallel scores further define a seventh substantially planar section of the shipping article, wherein when the piece of substantially flat material is folded along the parallel scores, two of the planar sections of the shipping article jointly form one of the two of the first pair of opposing, substantially parallel, spaced-apart sides, and a single third planar section of the shipping article forms the other of the first pair of opposing, substantially parallel, spaced-apart sides.

19. An improved shipping article comprising:

a single piece of substantially planar material with parallel scores formed therein thereby defining six substantially planar sections of the shipping article, the six planar sections of the shipping article defining, when the piece of substantially planar material is folded along the parallel scores:

a first pair of opposing, substantially parallel, spaced-apart sides;

a second pair of opposing, substantially parallel, spaced-apart sides that are substantially perpendicular to the first pair of sides; and a pair of dividing walls located adjacent each other and dividing a compartment formed by the first and second pairs of sides into two sub-compartments;

wherein each of the planar sections defining the dividing walls comprises:

a top extension sized and shaped to fold down to form a top of one of the sub-compartments; and a bottom extension sized and shaped to fold up to form a bottom of one of the sub-compartments;

wherein one or more of the sides of the first pair of opposing sides or the second pair of opposing sides comprises an item-separating shelf formed as a portion of the single piece of substantially planar material detached from its respective side except along a line substantially perpendicular to the parallel scores, whereby the shelf is adapted to fold into one of the sub-compartments to separate such sub-compartment into vertically spaced sub-sub-compartments; and wherein each of the top extensions comprises a hole therein sized to receive a human finger or thumb to facilitate lifting of the shipping article by the top extensions during insertion of or removal of the shipping article from a secondary shipping container.

20. The shipping article of claim 19, wherein the single piece of substantially planar material comprises corrugated cardboard.

* * * * *